US005392755A

United States Patent [19]

Sutton

[11] Patent Number: 5,392,755

[45] Date of Patent: Feb. 28, 1995

[54] LAUNCHING MECHANISM

[75] Inventor: Donald G. Sutton, Cromwell, New Zealand

[73] Assignee: Lanfield Holdings Limited, Cromwell, New Zealand

[21] Appl. No.: 105,631

[22] Filed: Aug. 13, 1993

[30] Foreign Application Priority Data

Nov. 24, 1992 [NZ] New Zealand ..... 245238

[51] Int. Cl.[6] ..... F41B 3/00

[52] U.S. Cl. ..... 124/5; 124/4

[58] Field of Search ..... 124/4, 5; 273/416, 417, 273/423, 329, 330, 331, 345, 346, 347

[56] References Cited

U.S. PATENT DOCUMENTS

| | | | |
|---|---|---|---|
| 1,178,028 | 4/1916 | Schlueter | 124/5 |
| 1,374,420 | 4/1921 | Berggreen . | |
| 1,400,097 | 12/1921 | Perkins . | |
| 2,012,424 | 8/1935 | Fincke . | |
| 2,638,708 | 5/1953 | Grow . | |
| 2,817,185 | 12/1957 | Johnson . | |
| 3,032,345 | 5/1962 | Lemelson | 273/346 |
| 3,788,641 | 1/1974 | Lemelson . | |
| 3,953,030 | 4/1976 | Muchnick | 273/346 |
| 4,166,618 | 9/1979 | Sheem . | |
| 4,789,161 | 12/1988 | Waskelo . | |
| 5,031,908 | 7/1991 | Spector . | |
| 5,080,374 | 1/1992 | Yu . | |
| 5,123,655 | 6/1992 | Rones . | |
| 5,141,465 | 8/1992 | Stellman . | |
| 5,195,745 | 3/1993 | Rudell et al. | 273/346 |

FOREIGN PATENT DOCUMENTS

| | | | |
|---|---|---|---|
| 53605 | 11/1910 | Switzerland | 124/5 |
| 2007514 | 5/1979 | United Kingdom | 273/416 |

*Primary Examiner*—Randolph A. Reese
*Assistant Examiner*—Anthony Knight
*Attorney, Agent, or Firm*—Bacon & Thomas

[57] ABSTRACT

A launcher mechanism for flying an article, the mechanism includes a handle, a release means, a cooperating means and a linking material. The arrangement being such that the cooperating means on the article is engaged with the release means, which is linked by the linking material to the handle. The article can be thrown by swinging the handle, the path of the article being guided by the path swept by the handle, until the impetus of the article is sufficient to part the increasingly separable engagement between the release means and the cooperating means. The article is released with a forward momentum.

9 Claims, 5 Drawing Sheets

LAUNCHING MECHANISM

FIELD OF INVENTION

The invention relates to games and playthings and particularly to a launcher mechanism for flying or throwing an article for a considerable distance or for aerobatics or at a target.

BACKGROUND OF THE INVENTION

At present when launching or throwing aeroplanes, darts or arrows there are inherent limitations because of the amount of force which can be created by a persons throwing arm action.

Slings provide added leverage, however these have an inherent limitation in that the pocket of a sling is typically unsuitable for a wide variety of articles.

Other launchers have included a stick and string arrangement, with the string being knotted and clipped onto an article such as a toy aeroplane.

Such a system is described in U.S. Pat. No. 1,400,097. The string is pulled or swung with the aeroplane attached. The string is then stopped or the direction in which the string is pulled is reversed and the string releases from the clip. This may deflect the path of the aeroplane or reduce its momentum.

An object of this invention is to overcome at least in part the above-identified disadvantages and to provide a launcher mechanism for flying or throwing an article.

A further object of the invention is to provide a launcher mechanism which offers some control over the launch impetus of an article and allows for a follow through of the throwing action.

A further object of the invention is to provide a launcher mechanism which offers a useful alternative choice.

Further objects and advantages of the invention will become apparent from the following descriptions which are given by way of example only.

SUMMARY OF THE INVENTION

According to a first aspect of the invention there is provided a launcher mechanism for an article, the mechanism including a handle, a release means, and a cooperating means, the arrangement being such that with the release means engaged to a cooperating means on the article, the article can be thrown by swinging the handle, the path of the article being constrained by the connection to the handle, by way of the engagement of the release means and the cooperating means, until the forward and centrifugal force of the article is sufficient to release the increasingly separable engagement between the release means and the cooperating means, the release means separating from the relative front of the cooperating means and gradually releasing as the path of the article and the path of the release means diverge, until the article is released with a forward momentum, the release means continuing on its path.

The launcher mechanism can have a linking material between the release means and the handle.

The impetus of the launch can be varied by changing the extent of the initial engagement between the release means and the cooperating means, particularly by varying the relative width of the engagement of the release means and the cooperating means.

It is possible to vary the launching action and judge the point at which the release means will disengage from the cooperating means and so have reasonably good control over the direction of the flight of the article.

The release means and cooperating means can be strips of a two component releasable fastening system suitable for contact engagement. It should be appreciated that if the two components differ as in the product VELCRO either of the two components can be used as the release means provided the other and different component is used as the cooperating means.

The article can be a toy or model aeroplane, dart, arrow, shaped flying mechanism or any other projectile.

The handle can be made of any length, shape or design. The handle can be operated manually or by means of a mechanical attachment.

The cooperating means can be attached in a permanent or semipermanent way to the article. The release means can be attached in a permanent or semipermanent way to the handle or any linking material between the handle and the release means.

The linking material can be a continuation of the release means material.

Preferably the forward end of the cooperating means will have a protective covering.

It is to be appreciated that the cooperating means can be attached to any position, such as the relative top, side or bottom, of the article.

Further aspects of the invention which should be considered in all its novel aspects will become apparent from the following descriptions.

Examples of the invention will now be described with reference to the accompanying drawings which show diagrammatically examples of the invention. For the purposes of these examples VELCRO has been used as the release means and the cooperating means.

DESCRIPTION OF THE PREFERRED EMBODIMENTS

In FIGS. 1–8 similar parts are referenced by the same numerals.

Figure 1:
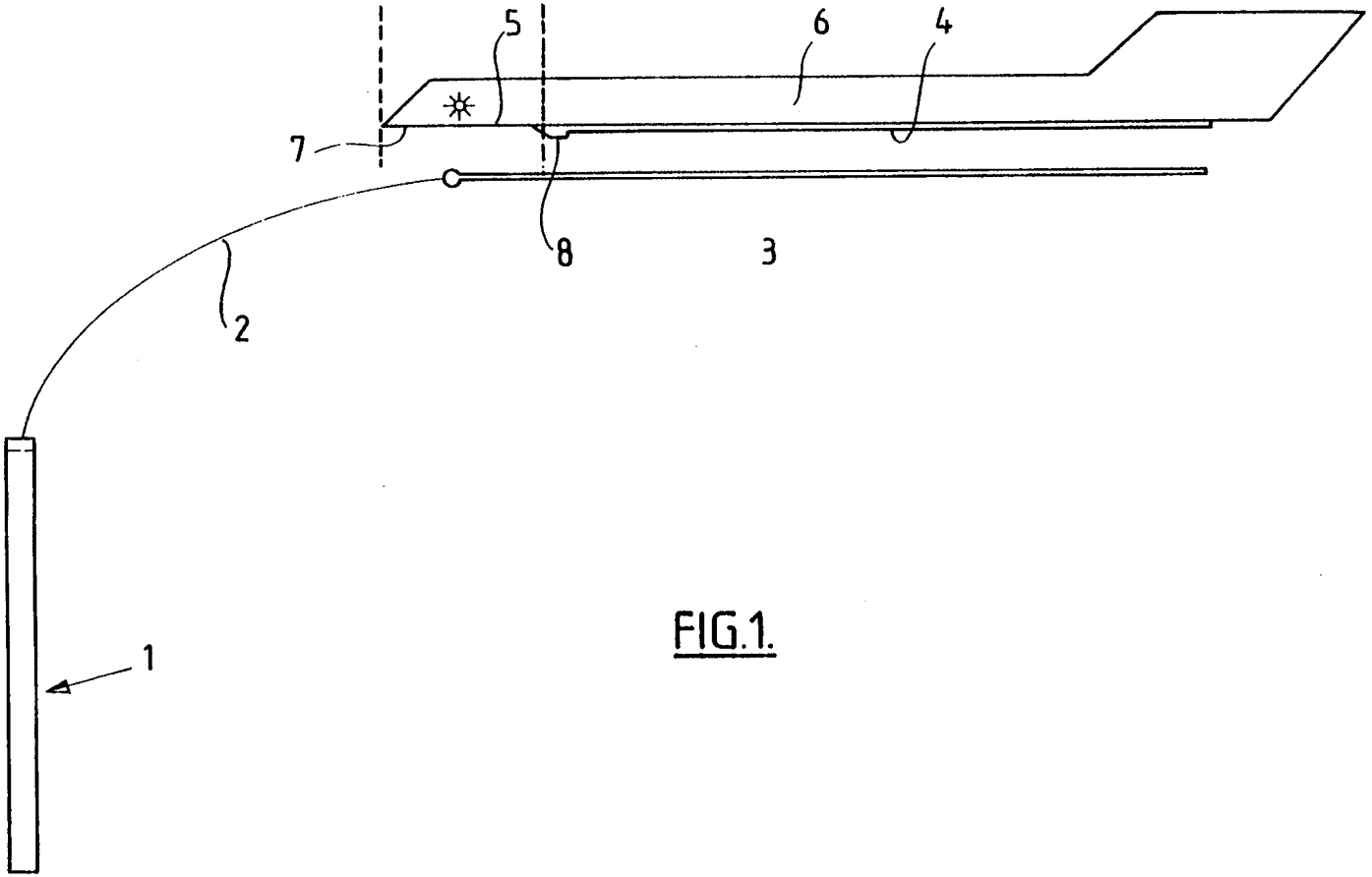
FIG. 1 shows from the side an example of the present invention.

In FIG. 1 the embodiment of the invention incorporates a launching handle 1, to which a cord 2 is attached. The free end of the cord 2 has a strip of looped VELCRO material attached as the release means 3.

A cooperating means 4, a strip of hooked VELCRO material, is shown attached to the lower surface 5 of the article 6. It is to be appreciated that the article can be any form of arrow or custom manufactured flying mechanism such as a toy or model aeroplane to suit a users preference.

Figure 4:
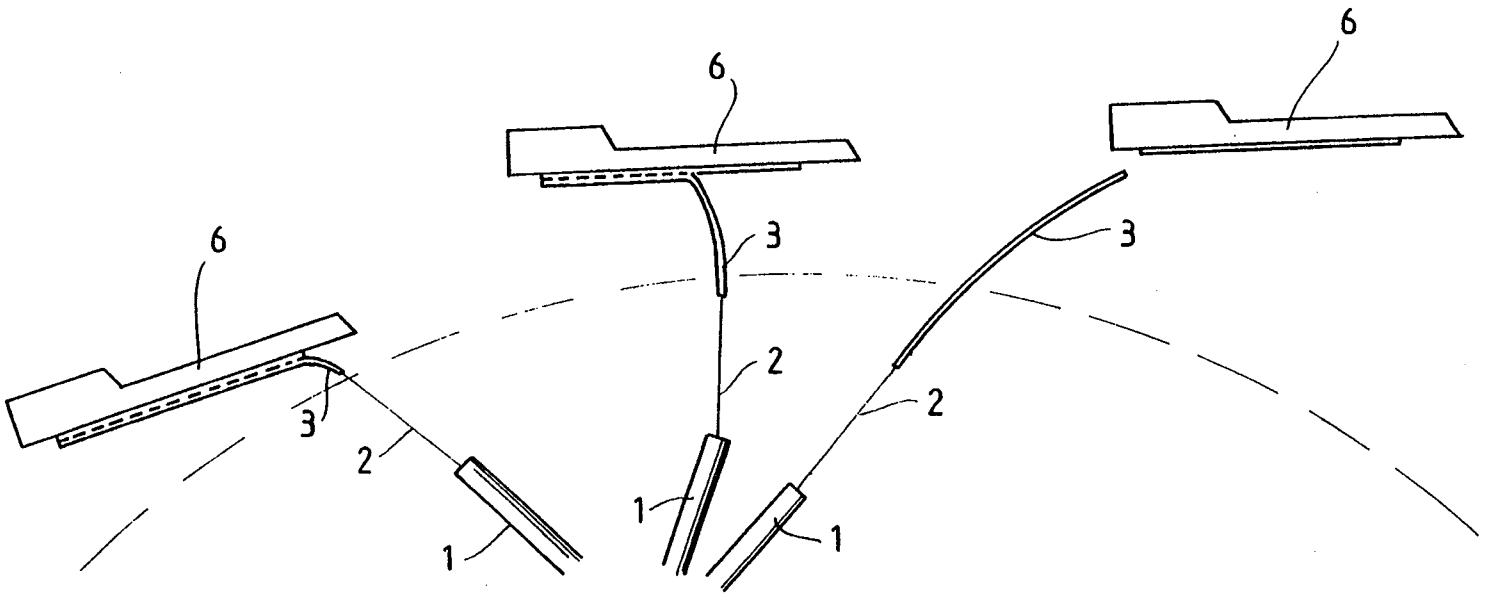
FIG. 4 shows diagrammatically launching operations of an article.

As is shown in FIG. 1 the applicant has found that it is best to leave the forward end 7 of the article 6 free of the cooperating means 4. This promotes the tearing action when the handle 1 is swung as is shown in FIG. 4.

Figure 8:
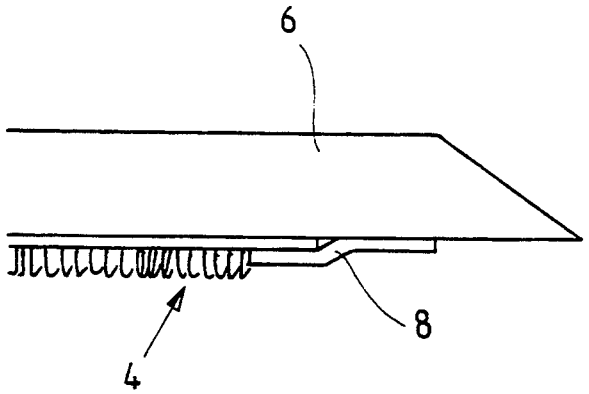
FIG. 8 shows a side view of part of an alternative example of the invention including a protective covering.

It is also an advantage to have a protective covering 8 on the forward end of the cooperating means 4 on the article. This further promotes the tearing action by reducing the degree of engagement between the foremost part of the release means and cooperating means as shown in FIG. 8. This protective covering 8 also protects the front of the cooperating means from damage and helps secure it.

Figure 3:
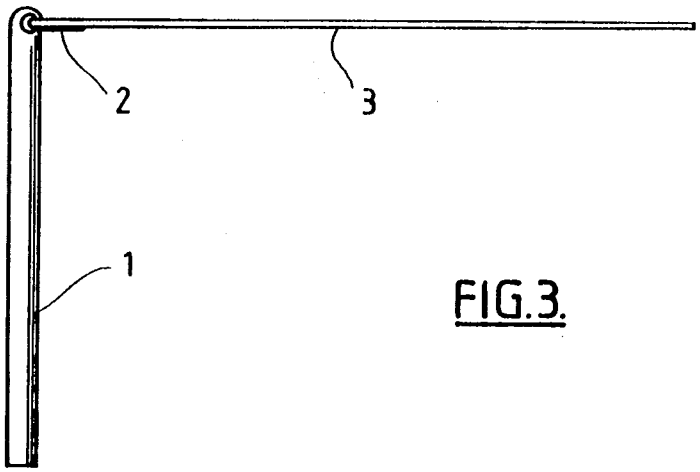
FIG. 3 shows an example of part of the invention.

In FIG. 3 the linking material is a continuation of the release means 3. The width and length of the release means can be chosen so that it can be used to launch a wide variety of articles. Each of the articles has their own cooperating means of a width and length to suit their weight, length and desired launching speed.

The width of the cooperating means attached to the article is the most important factor. Naturally the more effort required of the launching movement to make the release means and cooperating means part, the greater the launching speed. The lighter the article the narrower the cooperating means need be. If the engagement between the cooperating means and the release means is too wide for the weight of the projectile it will become too difficult to be launched.

Figure 5:
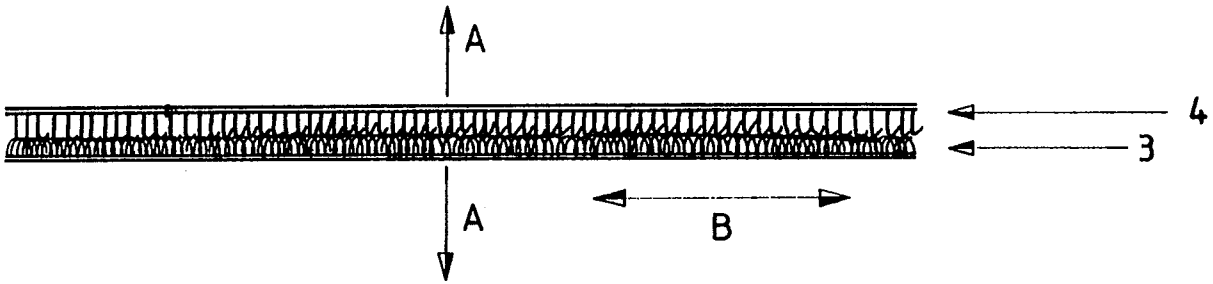
FIG. 5 shows a side view of an example of a cooperating means and release means engaged being part of the invention.

The amount of force required to separate the cooperating means and the release means is less when applied in the direction of arrows A, than when applied in the direction of arrows B in FIG. 5.

Figure 6:
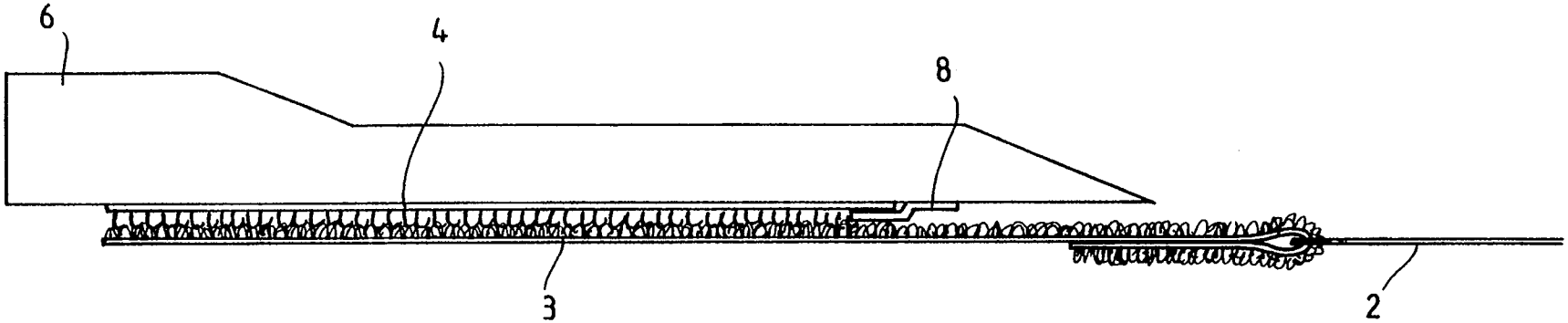
FIG. 6 shows a side view of an example of part of the invention.

In the initial stages of the launching movement the article is pulled by the cord in the approximate direction shown by arrow C in FIG. 6.

Figure 7:
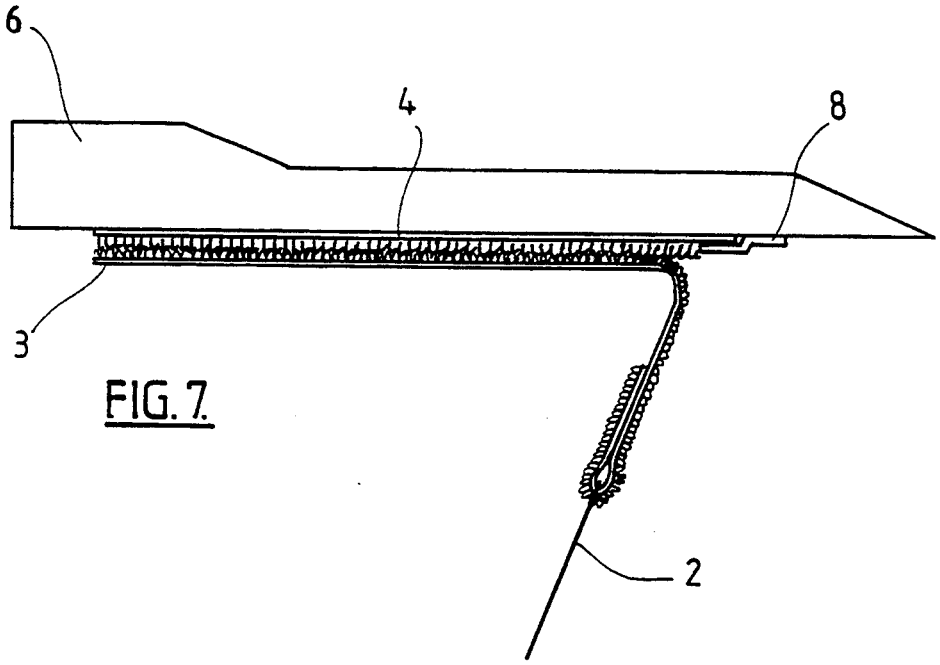
FIG. 7 shows a side view of an example of part of the invention.

As the article accelerates along its launching path, constrained by the engagement of the cooperating means and release means to the linking material and the handle, the angle at which the linking material pulls against the engagement of the release means and cooperating means changes from a position as in FIG. 6 where the release means and cooperating means will not separate easily, to a position as in FIG. 7 where the release means and cooperating means do separate easily. Once the engagement is broken the article continues along a path generated by the momentum of the launching movement and no longer constrained by the connection to the release means, linking material and handle.

The length of the strip attached to the article can be most of the length of the article. The applicant has found that the positioning of the front end of the cooperating means on the projectile is an important factor, as the area (just behind the protective covering) where the two strips first start to part in the latter stages of a launching swing, is a pivotal point during the earlier stages of a launching swing.

If this pivotal point is moved forward, the forward end 7 of the projectile that helps promote the tearing action, becomes correspondingly smaller. Thus, more effort will be required to make the release means and the cooperating means separate.

If this pivotal point is too far forward, the effort required for a successful launch may become too much.

Conversely, if the pivotal point is too far to the rear, a premature launch may result, with the added disadvantage of increased lateral movement of the projectile.

The length of the handle, release means or linking material is a matter of preference. The use of two cooperating surfaces as a means of release gives a long attachment which assists the articles stability as it is launched, relative lateral movement is minimised. This means a person launching the article requires little skill.

Figure 2:
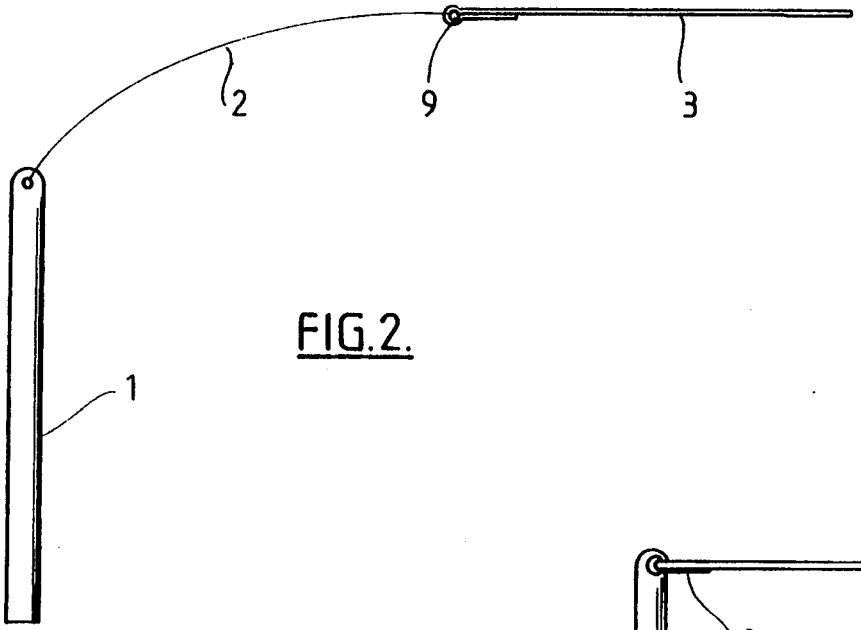
FIG. 2 shows an alternative example of part of the invention.

The applicant has discovered an example which is suitable for use by teenagers and adults, the example shown in FIG. 2.

In this example the launching handle is 900 mm in length, the linking material is a length of nylon cord 700 mmin length and the release means is 400 mm in length.

A plastics block 9 is provided at the end of the cord 2 for attachment to the release means 3. The cord is fed through holes in the release means and through or around the plastics block.

A number of advantages are apparent for the invention and these are as follows:

(1) The throwing action does not have to stop or slow down to release the article. There is a follow through action. This allows the operator to concentrate his movements on power and direction.

(2) There is very little lateral movement of the projectile created during the launching process. Less lateral movement means less air resistance, resulting in greater distance.

(3) The launching mechanism can throw a well constructed toy or model aeroplane, dart, arrow or missile to a distance exceeding 100 meters;

(4) Good direction and accuracy can be achieved with this launching mechanism;

(5) The launching mechanisms can launch toy or model aeroplanes, gliding or aerobatic articles;

(6) The launching mechanisms can be operated by children as young as 4 or 5 years old because of its simplicity;

(7) The launching mechanisms can be made relatively safe for children by making it small and of soft materials (including projectiles); and (8) It is envisaged that the launching mechanisms can be produced inexpensively.

The launching action can be directly overhead or any comfortable action such as an angle to the right side of the person launching the projectile. The person launching the article can be stationary or moving such as running forward to increase the momentum of the article.

It is envisaged that the launching mechanism be used for aerobatics as well as a target sport for adults similar to archery. This would include distance throwing competitions and target competitions. The target could be either on the ground or a large conventional upright target.

Also a game similar to golf is contemplated on a course with a variety of different articles being used as required, depending on parameters of the game.

Thus by this invention there is provided an easy to use and effective launcher mechanism for flying or throwing an article a considerable distance, aerobatically or at a target.

Particular examples of the invention have been described and it is envisaged that improvements and modifications can take place without departing from the scope and spirit of the appended claims.

What is claimed is:

1. A launching mechanism for an article, said article having longitudinally spaced leading and trailing ends, said mechanism including:

an elongated cooperating means having a leading end and a trailing end, said cooperating means being mountable on the article with the leading end of said cooperating means spaced from the leading end of the article;

an elongated release means having a leading end and a trailing end, said release means being releasably engageable with said cooperating means such that, when said release means is engaged with said cooperating means the leading end of said release means is located closer to the leading end of said article than the leading end of said cooperating means, said release means is aligned with said cooperating means; and a handle connected to the leading end of said release means wherein, with said cooperating means mounted on the article and engaged with said release means, when said handle is swung forwards along an arcuate path, the centrifugal force acting on the article initiates separation of the leading end of said release means from the leading end of said cooperating means and results in a progressive separation of said release means from said cooperating means until full separation and resultant launch of the article occurs.

2. A launching mechanism as claimed in claim 1 wherein the release means is connected to the handle by an elongated linking material.

3. A launching mechanism as claimed in claim 2 wherein the handle is a rod.

4. A launching mechanism as claimed in claim 2 wherein the impetus of the launch is varied by changing the extent of the initial engagement between the release means and the cooperating means, particularly by varying the relative width of the engagement of the release means and the cooperating means.

5. A launching mechanism as claimed in claim 2 wherein the impetus of the launch can be varied by changing the positioning of the cooperating means in relation to the leading end of the article.

6. A launching mechanism as claimed in claim 2 wherein the release means and cooperating means comprises strips of a two component releasable fastening system suitable for contact engagement.

7. A launching mechanism as claimed in claim 6 wherein the article is a projectile such as a toy aeroplane, dart, arrow or flying mechanism.

8. A launching mechanism as claimed in claim 2 wherein a leading end of the cooperating means has a protective covering.

9. A launching mechanism as claimed in claim 2 wherein the linking material is a continuation of the release means.

* * * * *